US007854151B2

(12) United States Patent
Starbuck

(10) Patent No.: US 7,854,151 B2
(45) Date of Patent: Dec. 21, 2010

(54) NEEDLE FOR KNITTING SUEDED FABRICS

(75) Inventor: Michael Starbuck, Earl Shilton (GB)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 12/616,313

(22) Filed: Nov. 11, 2009

(65) Prior Publication Data

US 2010/0116000 A1 May 13, 2010

(51) Int. Cl.
*D04B 35/04* (2006.01)

(52) U.S. Cl. ..... 66/121; 66/123

(58) Field of Classification Search ..... 66/121–124
See application file for complete search history.

(56) References Cited

U.S. PATENT DOCUMENTS 263,999 A * 9/1882 Truitt ..... 66/84 R
1,120,989 A * 12/1914 Williams ..... 66/121
2,188,125 A * 1/1940 Wigley ..... 66/95
2,335,075 A * 11/1943 Needham ..... 66/8
2,364,649 A * 12/1944 Palliser ..... 66/117
2,854,836 A * 10/1958 Morris ..... 66/121
3,040,551 A * 6/1962 Urlaub ..... 66/197
3,041,859 A 7/1962 Lie et al.
3,241,337 A 3/1966 Stevens
3,765,193 A 10/1973 Conroux et al.
3,940,917 A * 3/1976 Strachan ..... 57/207
4,026,126 A 5/1977 Nuber
4,127,013 A 11/1978 Nuber
4,409,800 A 10/1983 Gutschmit et al.
4,537,048 A 8/1985 Gutschmit et al.
4,592,212 A 6/1986 Schmidt
4,712,281 A 12/1987 Scheller
5,025,644 A 6/1991 Nielsen et al.
5,090,218 A * 2/1992 Schuler et al. ..... 66/121
5,186,025 A 2/1993 Neher
5,205,140 A * 4/1993 Nielsen et al. ..... 66/147
5,239,844 A * 8/1993 Sos ..... 66/12
5,463,882 A 11/1995 Yeh
5,855,125 A 1/1999 Lohmueller et al.
5,862,681 A 1/1999 Schmidt
5,916,273 A * 6/1999 Hepfinger ..... 66/194
6,094,944 A 8/2000 Schmidt
6,128,930 A 10/2000 Schmidt
6,242,370 B1 * 6/2001 Dischler ..... 442/181
6,298,692 B1 * 10/2001 Kuroda et al. ..... 66/123
6,430,968 B2 * 8/2002 Juenthner ..... 66/121
7,552,602 B2 6/2009 Knight, Sr. et al.
7,634,922 B2 12/2009 Starbuck

* cited by examiner

*Primary Examiner*—Danny Worrell
(74) *Attorney, Agent, or Firm*—Womble Carlyle Sandridge & Rice, PLLC

(57) ABSTRACT

A knitting needle for knitted sueded fabric is provided. The needle includes a shank, a hook, a latch, and an abrasive surface. The abrasive surface is defined on at least one of the shank, the hook, and the latch.

8 Claims, 4 Drawing Sheets

NEEDLE FOR KNITTING SUEDED FABRICS

CROSS-REFERENCE TO RELATED APPLICATIONS

This application claims the priority to U.S. patent application Ser. No. 11/485,514 filed on Jul. 12, 2006, which claims the benefit of U.S. Provisional Patent Application Ser. No. 60/738,482, filed Nov. 21, 2005, the contents of which are incorporated herein by reference.

BACKGROUND OF THE INVENTION

1. Field of the Invention

The present invention is related to knitting needles for knitting sueded fabrics, the needles having at least one abrasive surface.

2. Description of Related Art

In the textile industry, it is known to finish certain woven, weft knitted, and warp knitted fabrics by abrading one or both surfaces of the fabric. The knitted fabric is abraded using sandpaper or a similarly abrasive material to cut and raise the constituent surface of the yarns knitted in the fabric into a closely raised nap, producing a soft, smooth surface texture resembling suede leather. This operation is commonly referred to as sueding, sanding, brushing, emerising, or napping (hereinafter "sueding" or "sueded").

Sueding is conventionally performed by a specialized fabric machine that passes a knitted fabric over one or more finishing rolls, normally after the fabric has been dyed. The finishing rolls are covered with abrasive material and are rotated rapidly against the surface of the fabric. Unfortunately, conventional sueding operations have several significant disadvantages.

For example, conventional sueding processes require the knitted fabric to undergo one or more separate sueding processes after the knitting process, which can increase the cost of the resultant fabric.

In addition, conventional sueding machines necessarily cause a substantial amount of fibrous lint and fly, abrasive dust, and the like to be released from the fabric and the abrasive rolls (hereinafter "debris"). The debris can become airborne, posing a health hazard to machine operators. In addition, the debris may become embedded in the interstices of the fabric, detracting from its surface finish. Still other of the debris may accumulate on the abrasive surface of the finishing rolls, tending to negate at least somewhat their abrasive sueding effect.

Further, conventional sueding machines are typically limited in their operational widths to the processing of fabrics no greater on average than 60 to 65 inches in width. On the other hand, many conventional weaving and warp knitting machines are available for producing fabrics in widths two to three times or more greater in width than the effective operating width of conventional sueding equipment. Thus, when it is desired to produce a suede finish on fabrics of such greater widths than the maximum widthwise finishing capability of sueding machines, it is necessary to initially cut the fabric lengthwise into a least two smaller width lengths which are then individually processed through a sueding machine. Subsequently, the cut fabric must then be rejoined.

Still further, conventional sueding machines can produce streaks within the resultant fabric. These are relatively lighter or darker lines that appear in the warp direction. While these may be due to fabric or yarn irregularities, they may also occur due to random variation in the grit particles on the sueding machine. If a particularly large or aggressive particle is present in a particular location on the sueding machine, more fibers will be cut in that area such that lighter colored fibers in the yarn core may be exposed in that area, producing a streak. One method of mollifying the effect of individual grit particles is to make the abrasive drum very large so that the effect of a single grit particle is not continuous. However, this method reduces the pressure of the fabric against the treatment roll, requiring either relatively coarse grit, or some other means to create pressure, such as through the utilization of flaps, backup rolls, or air pressure. Another method to make the streak more difficult to observe is to oscillate the treatment rolls along the rotational axis, which creates a sinusoidal pattern on the fabric, so that the effect of single grit particles is spread out. Oscillation is often used in multi-roll treatment machines, with the oscillations timed so as not to be superimposed. All of these processes require specialized equipment that tends to further increase the cost of the resultant fabric.

Another common problem with conventional sueding processes is that the cutting of fibers reduces the tensile properties of the fabric, regardless of yarn type.

In addition, since the sueding is conventionally performed after the fabric has been dyed there is also typically a shade change from the dyed product to the sueded one, which can be difficult to control.

Accordingly, there is a need for sueded fabrics and methods of knitting such fabrics that overcome and/or mitigate one or more of the aforementioned deleterious effects of the prior art.

BRIEF SUMMARY OF THE INVENTION

It is an object of the present invention to provide a knitting needle that suedes a yarn as the yarn is knitted into a fabric.

It is another object to provide a method of knitting a sueded fabric that includes using a knitting needle having an abrasive surface and moving a yarn across the abrasive surface while knitting the fabric.

It is yet another object to provide a sueded knitted fabric that includes sueded yarns throughout the body of the fabric.

These and other objects and advantages of the present invention are provided by a knitting needle having a shank, a hook, a latch, and an abrasive surface. The abrasive surface is defined on the shank, the hook, the latch, and any combinations thereof.

These and other objects and advantages of the present invention are provided by a method of knitting a sueded fabric that includes forming an abrasive surface on a knitting needle, moving said knitting needle through a knitting cycle, and moving a yarn across said abrasive surface to form fibrils on said yarn as said knitting needle is moving through said knitting cycle.

Still other objects and advantages of the present invention are provided by a suede knitted fabric having a technical face, a technical back, and a knitted body. The technical face, technical back, and knitted body each include sueded yarns.

The above-described and other features and advantages of the present invention will be appreciated and understood by those skilled in the art from the following detailed description, drawings, and appended claims.

DETAILED DESCRIPTION OF THE INVENTION

Figure 1:
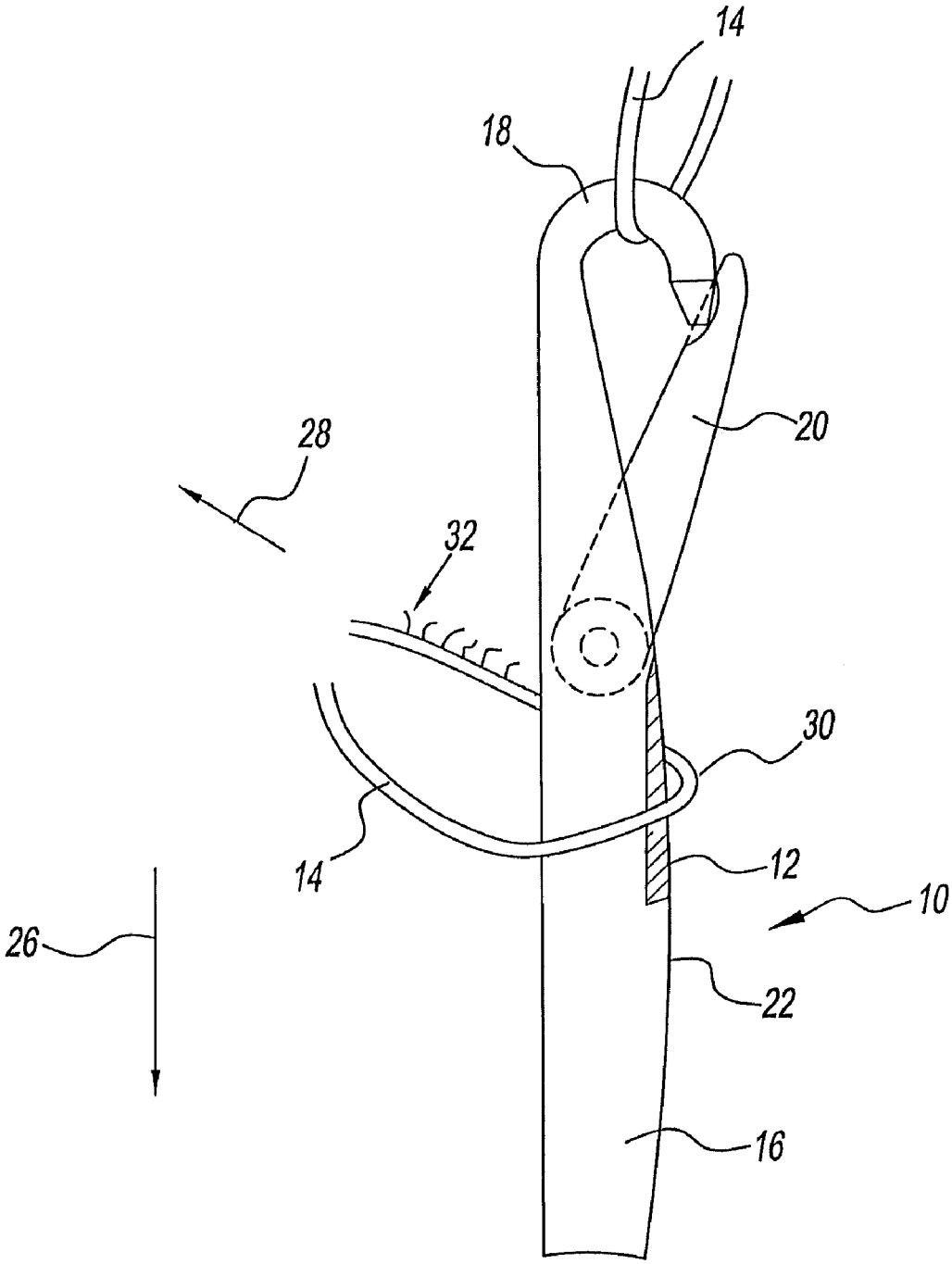
FIG. 1 is a side view of an exemplary embodiment of a knitting needle according to the present disclosure shown in a casting off position of the knitting cycle.

Referring to the drawings and in particular to FIG. 1, a knitting needle according to the present disclosure is generally illustrated by reference numeral 10. Advantageously, needle 10 includes at least one abrasive surface 12 defined thereon for abrading a yarn 14 during the knitting process. In this manner, needle 10 can be used to knit sueded fabrics.

Needle 10 includes a shank 16, hook 18, and a latch 20. Abrasive surface 12 can be formed on the shank 16, hook 18, latch 20, or combinations thereof.

In the embodiment illustrated in FIG. 1, abrasive surface 12 is defined on shank 16 at least at a front region 22 of the shank. Front region 22 is the side of needle 10 proximate the open side of hook 18. It is also contemplated by the present disclosure for abrasive surface 12 to be defined circumferentially about shank 16.

Abrasive surface 12 has a predetermined surface roughness. In one embodiment, abrasive surface 12 can be formed by knurling, scuffing, or otherwise roughing the surface finish of shank 16 in region 22. In another embodiment, abrasive surface 12 can be formed by applying an abrasive coating or paint to region 22 of shank 16. In still another embodiment, abrasive surface 12 can be formed by applying an abrasive element such as, but not limited to, a layer of emery paper (not shown) to region 22 of shank 16. Thus, abrasive surface 12 can be integral to and/or attached to shank 16.

The predetermined surface roughness of abrasive surface 12 is dependent upon, at least in part, the desired hand feel in the resulting fabric and the composition of yarn 14. Preferably, the predetermined surface roughness of abrasive surface 12 is sufficient to only mildly suede yarn 14. Specifically, the predetermined surface roughness of abrasive surface 12 is sufficient to form fibrils 32 at the surface of yarn 14, without cutting through the yarn.

As will be described in detail below, during a loop casting off portion of the knitting operation, needle 10 is moved in a first direction 26 so that yarn 14 is pulled across region 22 to cast off a knitted loop 30. As needle 10 is used to form knitted loop 30, yarn 14 is in contact with abrasive surface 12 while the needle is moving in the first direction 26 and the loop is pulled in a second direction 28. It has been found that the movement of needle 10 and loop 30 in first and second directions 26, 28, respectively, while yarn 14 is in contact with abrasive surface 12, suedes the yarn during the formation of the knitted loop 30 to form fibrils 32 at the surface of the yarn.

Accordingly, needle 10 having abrasive surface 12 at region 22 allows knitted loop 30 to be sueded directly on the knitting machine during the casting off of the knitted loop from the needle. Advantageously, the resulting fabrics knitted with needle 10 are sueded with no extra labor costs or process costs. Further, the resulting fabrics knitted with needle 10 have yarns 14 that are sueded throughout the body of the fabric. In contrast, fabrics exposed to a sueding process after knitting merely have sueded surfaces (i.e., face and/or back).

Since needle 10 provides yarns 14 that are sueded throughout the body of the fabric, the resulting fabric can be produced with substantially no face-to-back differentiation in color and/or hand-feel.

Figure 2:
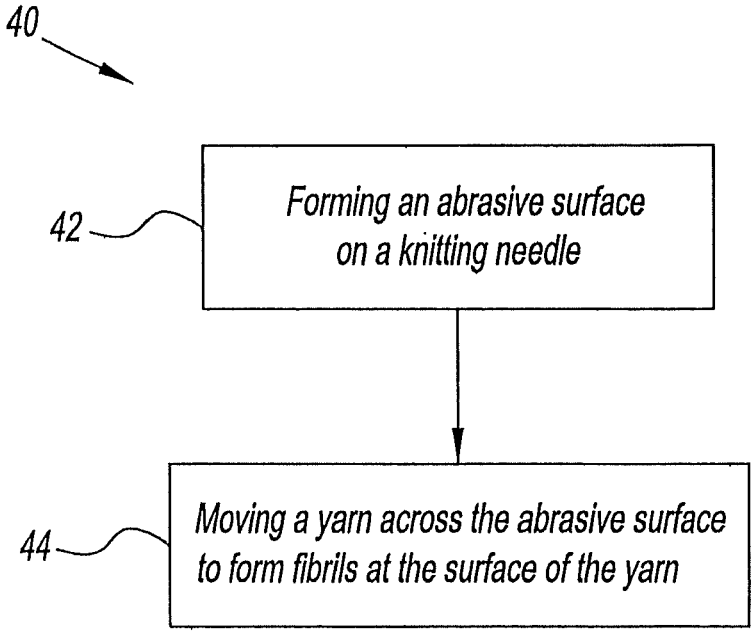
FIG. 2 is a block diagram of a method of knitting a sueded fabric according to an exemplary embodiment of the present disclosure.

Referring now to FIG. 2, a method of knitting a sueded fabric according to the present disclosure is generally illustrated by reference numeral 40. Method 40 includes a first step 42 and a second step 44. First step 42 includes forming abrasive surface 12 on needle 10. Second step 44 includes moving yarn 14 across abrasive surface 12 to form fibrils 32 at the surface of the yarn as needle 10 is forming loop 32 from the yarn. Second step 44 is repeated until a plurality of loops 30 are knitted to result in the sueded fabric being knitted.

Forming abrasive surface 12 on needle 10 of first step 42 can include knurling and/or scuffing region 22 of shank 16. In another embodiment, forming abrasive surface 12 on needle 10 of first step 42 can include applying an abrasive coating or paint to region 22 of shank 16. In still another embodiment, forming abrasive surface 12 on needle 10 of first step 42 can include applying an abrasive element, such as a layer of emery paper, to region 22 of shank 16.

Figure 3:
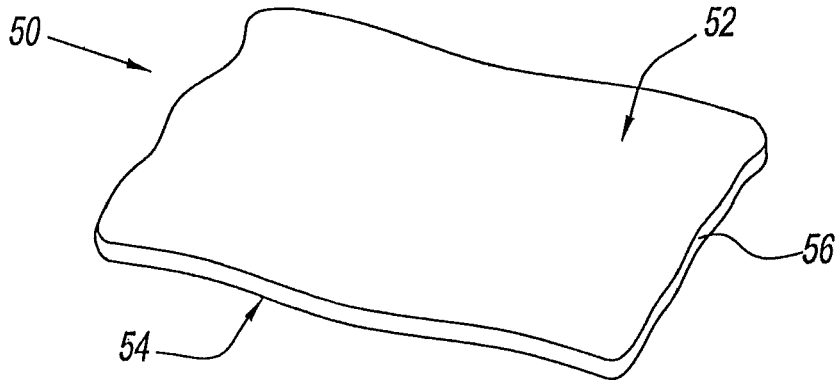
FIG. 3 is a top perspective view of a suede knitted fabric according to an exemplary embodiment of the present disclosure.

Referring now to FIG. 3, a sueded knitted fabric according to the present disclosure is generally illustrated by reference numeral 50. Fabric 50 includes a technical face 52, a technical back 54, and a knitted body 56. Fabric 50 is knitted from yarns that are sueded throughout body 56 of the fabric. Thus, fabric 50 has sueded yarns at technical face 52, technical back 54, and fabric body 56. Preferably, fabric 50 has substantially the same color and/or hand-feel at face and back 52, 54. Fabric 50 can be a weft knitted fabric or a warp knitted fabric.

It should be recognized that needle 10 is described herein by way of example as having abrasive surface 12 at front region 22 so that the needle suedes loop 30 during the casting off of the knitted loop. Of course, it is contemplated for needle 10 to have abrasive surface 12 at any desired region of the needle so that the needle suedes yarn 14 during any part of the knitting cycle.

Needle 10 is illustrated in FIGS. 4 through 9 during various stages of the knitting cycle.

Figure 4:
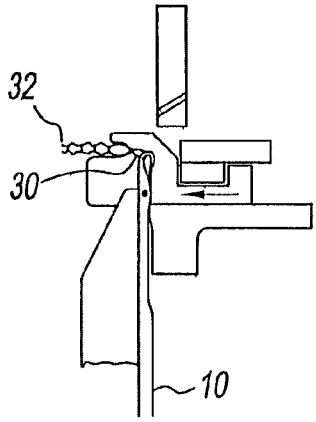
FIG. 4 is a side view of the knitting needle of FIG. 1, shown in a rest or ground position of the knitting cycle.

FIG. 4 shows needle 10 in a rest or ground position of the knitting cycle. Here, needle 10 is stationary with a previously knitted loop 30 enclosed in hook 18 by latch 20, which is in a closed position.

Figure 5:
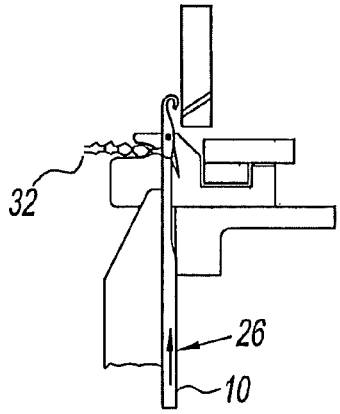
FIG. 5 is a side view of the knitting needle of FIG. 1, shown in a tuck height position of the knitting cycle.
Figure 6:
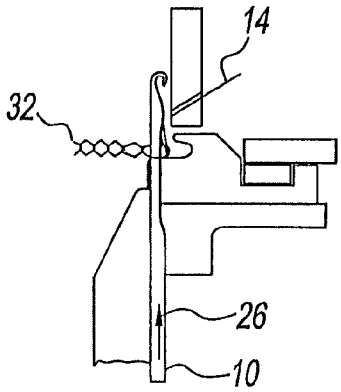
FIG. 6 is a side view of the knitting needle of FIG. 1, shown in a clearing height position of the knitting cycle.

FIG. 5 shows needle 10 moving upwards in first direction 26 and in a tuck height position of the knitting cycle. In the tuck height position, knitted fabric 32 is held stationary as latch 20 is moved to an open position. Needle 10 continues to move upward until it reaches a clearing height position as shown in FIG. 6. In the clearing height position, needle 10 is ready to receive a new yarn 14.

Figure 7:
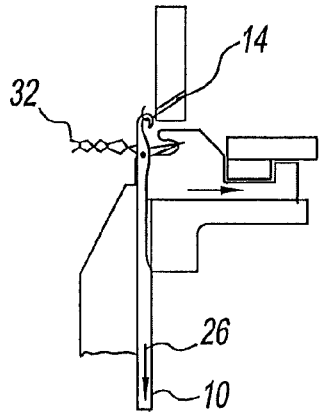
FIG. 7 is a side view of the knitting needle of FIG. 1, shown in a yarn feeding position of the knitting cycle.
Figure 8:
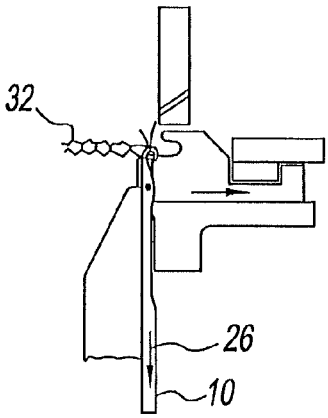
FIG. 8 is a side view of the knitting needle of FIG. 1, shown in a cast off position of the knitting cycle.
Figure 9:
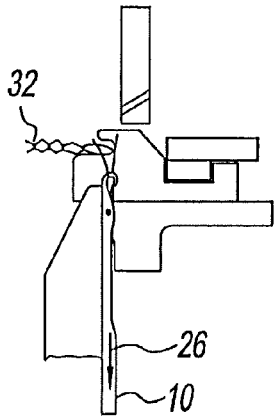
FIG. 9 is a side view of the knitting needle of FIG. 1, shown in a knock over position of the knitting cycle.

Needle 10 is shown in a yarn feeding position of the knitting cycle in FIG. 7. Here, needle 10 is moved downwards in first direction 26 so that the new yarn 14 is laid into hook 18 and latch 20 is moved to its closed position, forming a new loop therein. As the new loop is pulled downward by needle 10, the needle pulls the new loop through the old loop. Once needle 10 reaches its cast off position as shown in FIG. 8, the old loop is cast off into fabric 32 and the needle continues downward to the knock over position of the knitting cycle as shown in FIG. 9.

Figure 10:
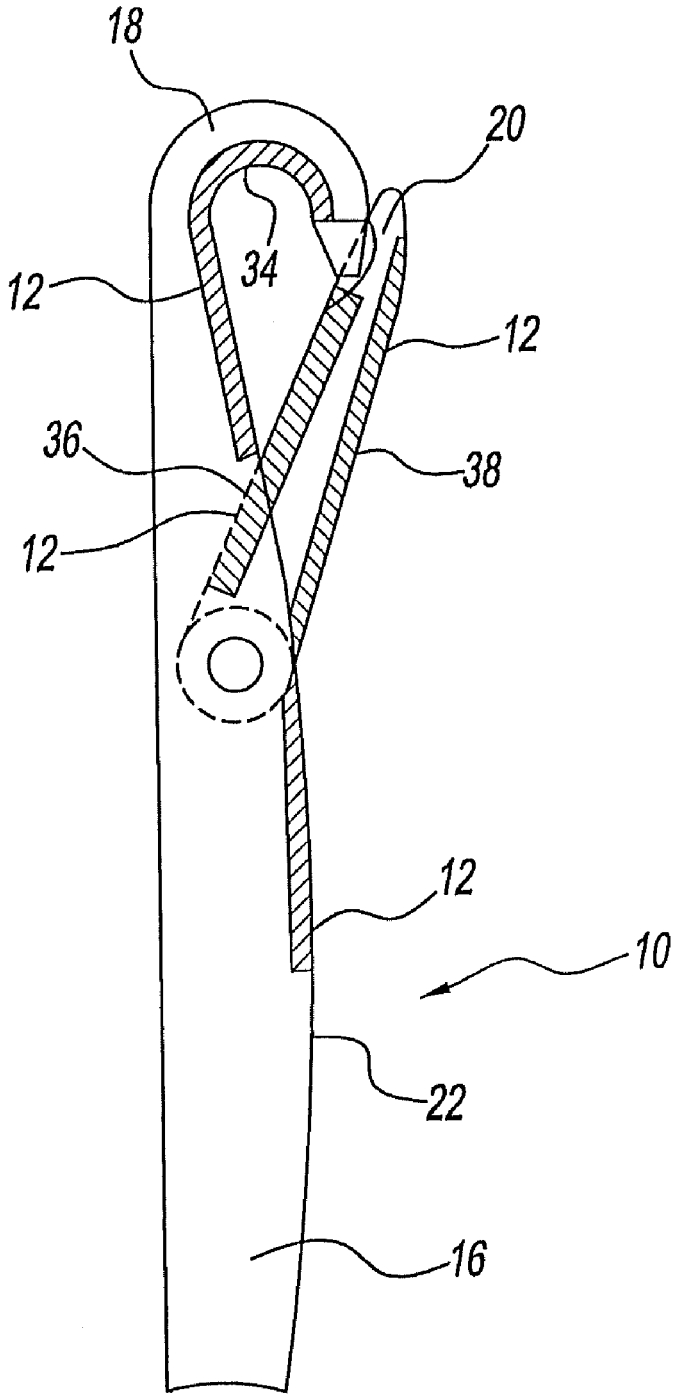
FIG. 10 is a side view of the knitting needle of FIG. 1 illustrating one or more regions of the needle having an abrasive surface.

Advantageously, needle 10 can include abrasive surface 12 at any region so that yarn 14 is sueded as the needle is moved through all, or any selected portion of the knitting cycle. For example as shown in FIG. 10, needle 10 can include abrasive surface 12 at an inner region 34 of hook 18 and/or an inner region 36 of latch 18 so that yarn 14 is sueded as the needle is moved between the rest position to the clearing height position, or any portions thereof. Also, needle 10 can include abrasive surface 12 at an outer region 38 of latch 18 so that yarn 14 is sueded as the needle is moved between the clearing height position and the cast off position, or any portions thereof.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

The invention claimed is:

1. A knitting needle for simultaneously knitting and abrading yarn, comprising:

a shank;

a hook;

a latch; and an abrasive surface defined on at least one of the shank, the hook, and the latch for simultaneously knitting and abrading the yarn without cutting the yarn.

2. The knitting needle of claim 1, wherein the abrasive surface is defined at a front region of said shank.

3. The knitting needle of claim 2, wherein the abrasive surface is defined circumferentially about the shank.

4. The knitting needle of claim 1, wherein the abrasive surface is defined at an inner region of the latch.

5. The knitting needle of claim 1, wherein the abrasive surface is defined at an outer region of the latch.

6. The knitting needle of claim 1, wherein the abrasive surface is defined at an inner region of the hook.

7. The knitting needle of claim 1, wherein the abrasive surface is defined at a region selected from the group consisting of an inner region of the hook, a front region of the shank, an inner region of the latch, an outer region of the latch, and combinations thereof.

8. The knitting needle of claim 1, wherein the abrasive surface is selected from the group consisting of a knurled region, a scuffed region, an abrasive coating, an abrasive paint, an abrasive element, and combinations thereof.

* * * * *